United States Patent [19]

Oka et al.

[11] Patent Number: 4,946,298

[45] Date of Patent: Aug. 7, 1990

[54] PRINTING APPARATUS

[75] Inventors: Shinya Oka; Shigeru Mori, both of Tokyo, Japan

[73] Assignee: Sony Corporation, Tokyo, Japan

[21] Appl. No.: 433,432

[22] Filed: Nov. 8, 1989

Related U.S. Application Data

[63] Continuation of Ser. No. 108,700, Oct. 15, 1987, abandoned.

[30] Foreign Application Priority Data

Oct. 18, 1986 [JP] Japan ..... 61-248158
Jun. 3, 1987 [JP] Japan ..... 62-139423

[51] Int. Cl.[5] ..... B41J 13/10; B41J 15/04
[52] U.S. Cl. ..... 400/605; 400/611
[58] Field of Search ..... 400/603, 603.1, 605, 400/611, 625

[56] References Cited

U.S. PATENT DOCUMENTS

| | | | |
|---|---|---|---|
| 4,164,376 | 8/1979 | Yarp | 400/605 |
| 4,234,261 | 11/1980 | Hendrischk et al. | 400/605 |
| 4,391,542 | 7/1983 | Baitz | 400/605 |
| 4,475,833 | 10/1984 | Sawicki | 400/605 |
| 4,579,471 | 4/1986 | Hendrischk | 400/605 |
| 4,671,686 | 6/1987 | Howes et al. | 400/605 |
| 4,722,623 | 2/1988 | Kikuchi et al. | 400/611 |
| 4,732,501 | 3/1988 | Angst et al. | 400/605 |

FOREIGN PATENT DOCUMENTS

| | | | |
|---|---|---|---|
| 0038415 | 10/1981 | European Pat. Off. . | |
| 0166132 | 1/1986 | European Pat. Off. . | |
| 2912656 | 10/1980 | Fed. Rep. of Germany | 400/605 |
| 137675 | 7/1985 | Japan | 400/605 |
| 66669 | 4/1986 | Japan | 400/605 |
| 73972 | 4/1987 | Japan | 400/605 |

OTHER PUBLICATIONS

IBM Technical Disclosure Bulletin, vol. 28, No. 4, Sep. 1985, pp. 1400–1401; Paper Path Switching Mechanism for Automatic Sheel Feeder in a Printer.

IBM Technical Disclosure Bulletin, vol. 23, No. 9, Feb. 1981, pp. 3965–3966: Single Sheet Insertion.

*Primary Examiner*—Edgar S. Burr
*Assistant Examiner*—Tonya Lamb
*Attorney, Agent, or Firm*—Lewis H. Eslinger; Donald S. Dowden

[57] ABSTRACT

A printing apparatus including a printing section defined between a platen and a printing head mounted for movement in parallel with the platen to convert information into printed form on a printing medium placed in the printing section. At least one pair of feed rollers is provided for feeding the printing medium to the printing section and at least one pair of discharge rollers is provided for discharging the printing medium from the printing section. The nip of the feed rollers are substantially flush with the printing section and the nip of the discharge rollers is substantially flush with the printing section. The printing apparatus includes two printing medium guide paths. The first guide path is curved for guiding the printing medium to the nip of the feed rollers. The second guide path extends straight toward the nip of the feed rollers. The second guide path is effective to feed a thick or inflexible printing medium to the printing section.

4 Claims, 7 Drawing Sheets

PRINTING APPARATUS

This is a continuation of application Ser. No. 108,700, filed Oct. 15, 1987, now abandoned.

BACKGROUND OF THE INVENTION

This invention relates to a printing apparatus including a printing section for converting information into printed form.

Conventional printing apparatus include a printing section defined between a platen and a printing head mounted for movement in parallel with the platen for scanning a printing medium fed into the printing section by means of at least one pair of feed rollers. The printing medium includes a single printing medium guide path for guiding the printing medium to the nip of the feed rollers. In order to meet the usual criteria of space requirement, the guide path has an entrance portion opening upward for entry of the printing medium and a discharge portion curved toward the nip of the feed rollers. Although such conventional printing apparatus are satisfactory for normal applications using thin or flexible printing mediums, serious problems will occur for thick or inflexible printing mediums. In addition, it is impossible to print data over the entire range of a printing medium from its upper end to its lower end.

SUMMARY OF THE INVENTION

Therefore, it is a main object of the invention to provide an improved printing apparatus which is compact and convenient in use.

It is another object of the invention to provide a printing apparatus which can handle any type of printing medium with no problem.

It is still another object of the invention to provide a printing apparatus which can print data substantially over the entire range of a printing medium from its upper end to its lower end.

There is provided, in accordance with the invention, a printing apparatus comprising a printing station including a platen and a printing head. In the printing station, a printing medium guided by the platen is scanned by the printing head for recording information. A first driving means is positioned ahead of the printing station for transporting the printing medium toward the printing station. A second driving means is positioned behind of the printing station for drawing the printing medium from the printing station. The printing apparatus also includes a first guide means coupled to a first entrance for guiding the printing medium to the first driving means and a second guide means coupled to a second entrance for guiding the printing medium to the first driving means.

In another aspect of the invention, there is provided a detachable printing apparatus which comprises a printing mechanism housed in a case, a connecting portion formed on one of walls of the case for mechanically connecting the case to a data handling apparatus, a connecting cable lead from the case, a connecting plug provided on the tip of the connecting cable for electrically connecting the printing mechanism to the data handling apparatus, and a hollow area formed in the one of the walls of the case for holding the connecting plug and the connecting cable.

BRIEF DESCRIPTION OF THE DRAWINGS

In the detailed description of the referred embodiments presented below, reference is made to the accompanying drawings wherein corresponding parts are identified by like numerals and in which.

DETAILED DESCRIPTION OF THE INVENTION

Figure 1:
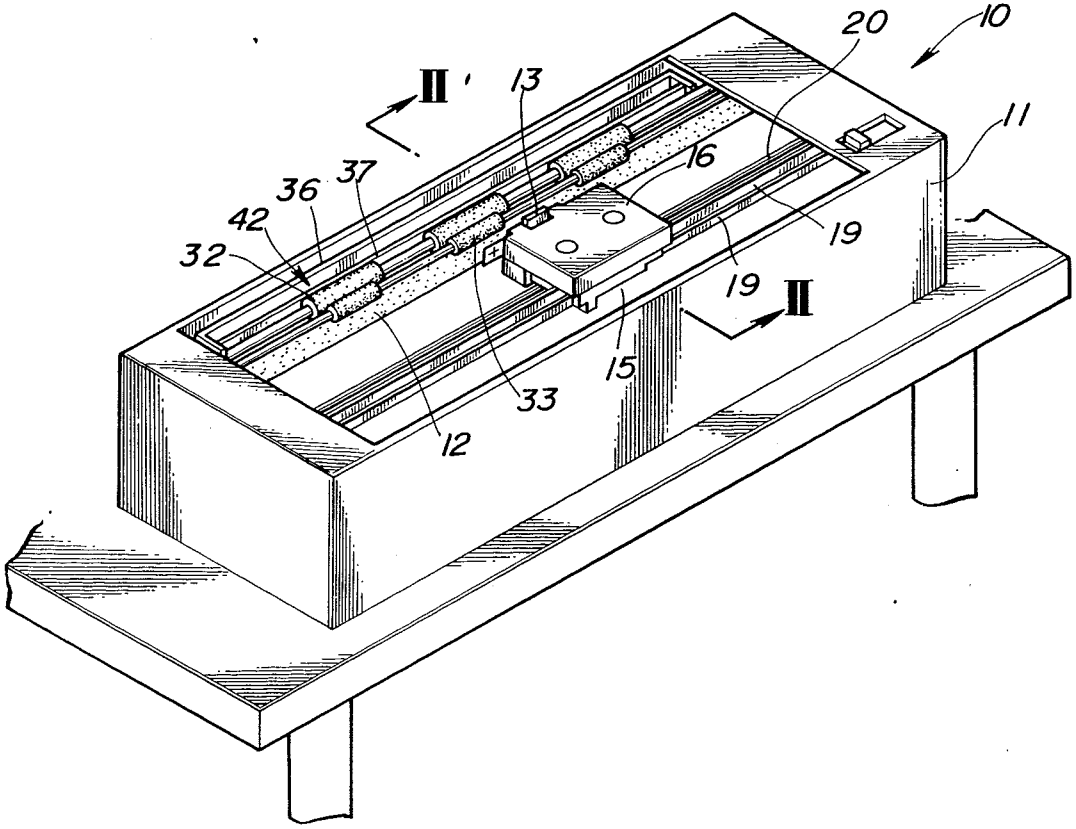
FIG. 1 is a perspective view showing one embodiment of a printer made in accordance with the invention.
Figure 2:
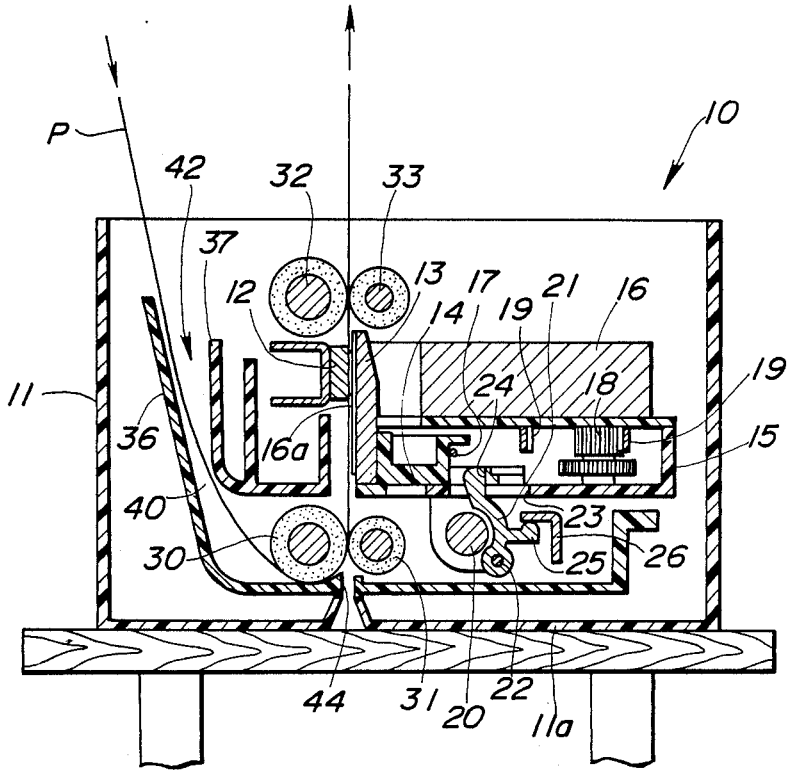
FIG. 2 is a sectional view taken along the line II—II of FIG. 1.

With reference to the drawings, wherein like numerals refer to like parts in the several views, and in particular to FIGS. 1 and 2, there is illustrated a printer embodying the invention. The printer, generally designated by the numeral 10, comprises a casing 11 having a rectangular opening directed upward in a first position, illustrated in FIGS. 1 and 2, where its bottom wall **11*a* is seated on a table. The printer 10 comprises a platen 12 having a flat surface and a thermal printing head 13 facing to the flat surface of the platen 12. The printing head 13 is mounted for movement in one or two directions parallel with the platen 12 for scanning a printing paper sheet or other printing medium guided on the platen 12. In greater detail, the printing head 13 is held for movement toward and away from the platen 12 by a head holder 14 which is carried on a carriage 15 along with a typewriter ribbon cartridge 16. The head holder 14 is urged to place the printing head 13 in pressure contact with the platen 12 under the resilient force of a spring 17. Information is printed through an ink ribbon 16*a* on a printing paper sheet in the printing section defined between the platen 12 and the printing head 13 held in contact with the platen 12. The printing section has an inlet through which the printing paper sheet is fed to the printing section and an outlet through which the printing paper sheet is discharged from the printing section. The carriage 15 has a cylindrical gear 18 held in mesh engagement with a rack 19 in a manner to permit reciprocating movement of the carriage 15 between predetermined leftmost and rightmost positions on a guide rod 20 extending in parallel with the platen 12. The carriage 15** returns to the left when it arrives at the predetermined rightmost position and returns to the right when it arrives at the predetermined leftmost position.

The numeral 21 designates a release lever having a first end rotatably mounted on a support shaft 22 provided below the carriage 15. The release lever 21 extends through an aperture 23 formed in the bottom wall of the carriage 15 and engages at a second end with an hole 24 formed in the head holder 14. The release lever 21 has a lever arm portion 25 having a free end held in engagement with the bottom surface of a push plate 26 having an L-shaped cross section. The push plate 26 has a length substantially the same as the length of the platen 12. The push plate 26 is provided on its opposite ends with arms (not shown) mounted rotatably on the guide rod 20. When the push plate 26 is pushed down, the release lever 21 rotates about the support shaft 22 in a clockwise direction, as viewed in FIG. 2, pushing the head holder 14 to move the printer head 13 away from the platen 12.

A plurality of pairs of feed rollers 30 and 31 are positioned near the inlet of the printing section. The feed rollers 30 are mounted on a shaft driven by an electric motor (not shown) and urged in pressure contact with the corresponding feed rollers 31 for feeding the printing paper sheet to the printing section. The nip of each pair of the feed rollers 30 and 31 is substantially flush with the printing section between the platen 12 and the printing head 13 held in contact with the platen 12. A plurality of pairs of discharge rollers 32 and 33 are positioned near the outlet of the printing section. The discharge rollers 32 are mounted on a shaft driven at the same speed as the feed rollers 30 by an electric motor (not shown) and urged in pressure contact with the corresponding discharge rollers 33 for discharging the printing paper sheet from the printing section. The nip of each pair of the discharge rollers 32 and 33 is substantially flush with the printing section. The discharge rollers 33 are mounted on a shaft which is movable to place the discharge rollers 33 into and out of pressure contact with the corresponding discharge rollers 32.

The printer 10 includes a first, curved guide path 40 having an entrance portion 42 defined by outer and inner plates 36 and 37 placed in spaced relationship with each other within the casing 11. The entrance portion 42 opens upward, as viewed in FIG. 2, for entry of a printing paper sheet P into the first guide path 40. The outer plate 36 curves and terminates below the feed rollers 30 at a small distance somewhat smaller than the thickness of the printing paper sheet P to permit the feed rollers 30 to feed the printing paper sheet P to the nip of the feed rollers 30 and 31 under a frictional force. As illustrated, the first guide path 40 has a discharge end directed toward the nip of the feed rollers 30 and 31. The printer 10 also includes a second, straight guide path 44 having an entrance formed in the bottom wall 11*a* of the casing 11 and extending straight toward the nip of the feed rollers 30 and 31. As illustrated, the second guide path 44 is substantially flush with the printing section defined between the platen 12 and the printing head 13.

The printer 10 can be used in two positions. In the first position, illustrated in FIGS. 1 and 2, a printing paper sheet P is entered through the entrance 42 into the first guide path 40. When the printing paper sheet P arrives at a position near the discharge end of the first guide path 40, the feed rollers 30 feed the printing paper sheet P toward the nip of the feed rollers 30 and 31 along the curved discharge portion of the first guide path 40. Thereafter, the feed rollers 30 and 31 feed the printing paper sheet P to the printing section defined between the platen 12 and the printing head 13. In the printing section, the printing head 13 urges the printing paper sheet P through the typewriter ribbon 16*a* against the platen 12 and converts data into printed form on the printing paper sheet P while the printing head 13 moves in parallel with the platen 12. An appropriate mechanism may be provided to feed the printing paper sheet P a predetermined length on the platen 12 in response to arrival of the printing head 13 at the predetermined right or left position. When the printing paper sheet P reaches the nip of the discharge rollers 32 and 33, the discharge rollers 32 and 33 feed the printing paper sheet P to the exterior of the printer 10.

Figure 3:
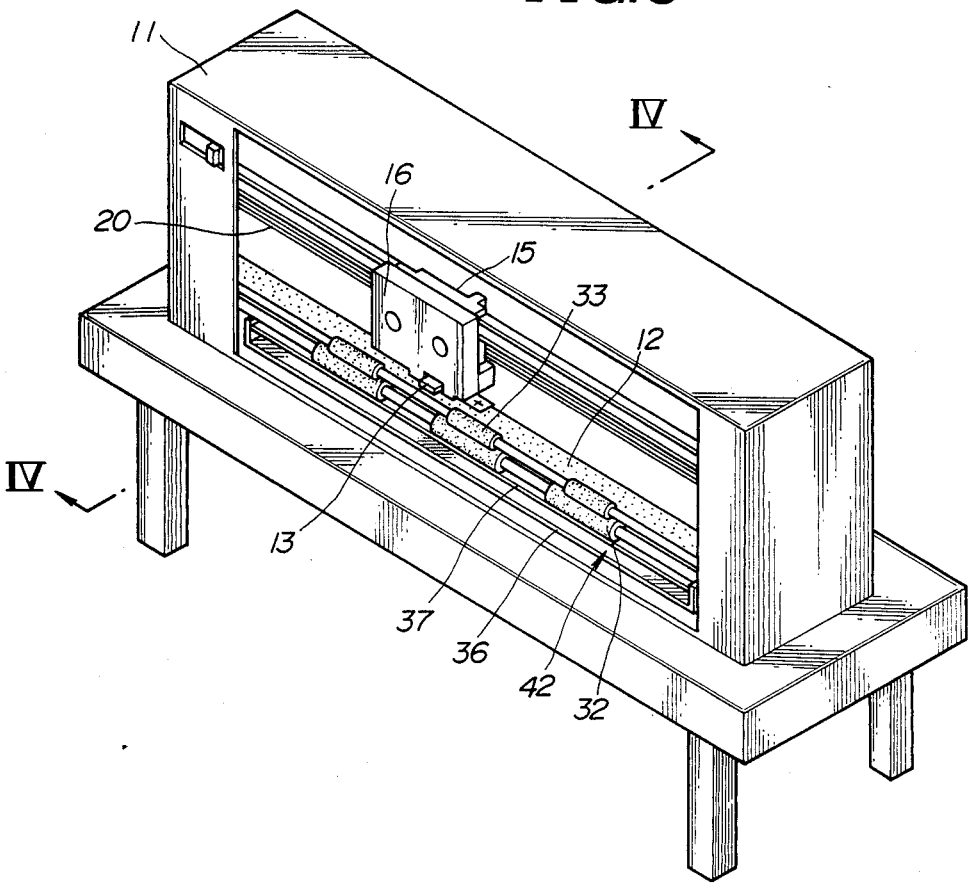
FIG. 3 is a perspective view showing the printer used in another position.
Figure 4:
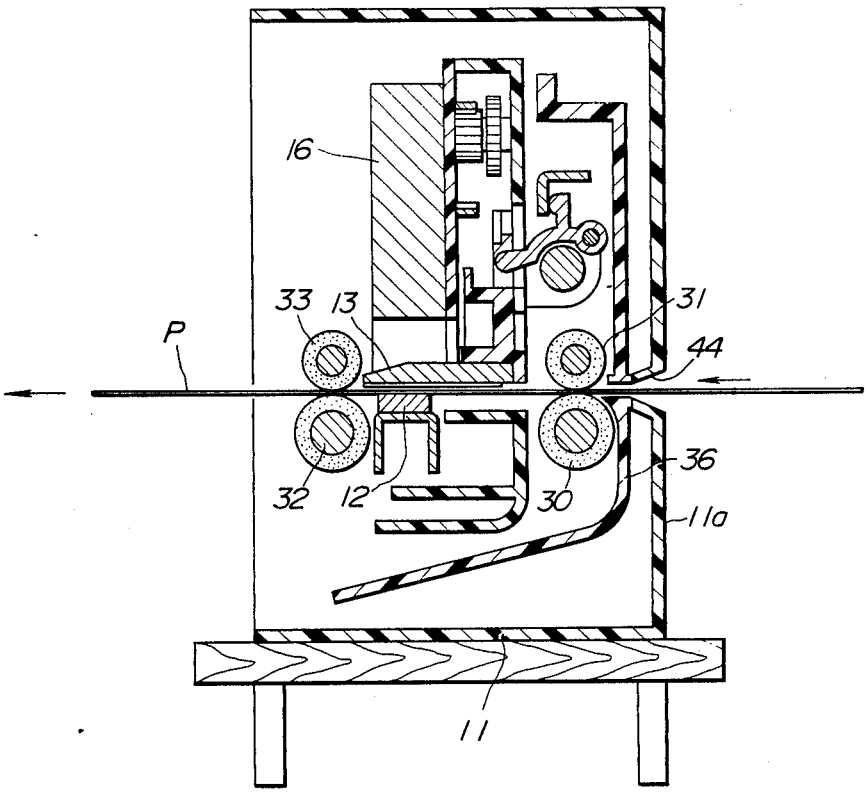
FIG. 4 is a sectional view taken along the line IV—IV of FIG. 3.

In the second position, illustrated in FIGS. 3 and 4, where the printer 10 is placed on the table with its opening facing to the operator, a printing paper sheet P is entered into the printer 10 through the second guide path 44 extending straight toward the nip of the feed rollers 30 and 31. The feed rollers 30 and 31 feed the printing paper sheet P to the printing section defined between the platen 12 and the printing head 13. In the printing section, the printing head 13 urges the printing paper sheet P through the typewriter ribbon 16*a* against the platen 12 and converts information into printed form on the printing paper sheet P while the printing head 13 moves in parallel with the platen 12. When the printing paper sheet P reaches the nip of the discharge rollers 32 and 33, the discharge rollers 32 and 33 feed the printing paper sheet P to the exterior of the printer 10.

As described previously, the printer 10 includes at least one pair of feed rollers 30 and 31, the nip of which is substantially flush with the printing section defined between the platen 12 and the printing head 13. Two guide paths are provided for selective use in guiding a printing medium P to the nip of the feed rollers 30 and 31. The operator can use the first guide path 40, which curves toward the nip of the feed rollers 30 and 31, for thin or flexible printing mediums by placing the printer 10 in the first position, as illustrated in FIGS. 1 and 2. The operator can use the second guide path 44, which extends straight toward the nip of the feed rollers 30 and 31, for thick or inflexible printing mediums by placing the printer 10 in the second position, as illustrated in FIGS. 3 and 4. In addition, the printer 10 includes at least one pair of discharge rollers 32 and 33 provided at a position near the outlet of the printing section for drawing the printing medium P from the printing section. The nip of the discharge rollers 32 and 33 are substantially flush with the printing section. This arrangement is effective to print data substantially over the entire range of the printing medium P from its upper end to its lower end.

Figure 5:
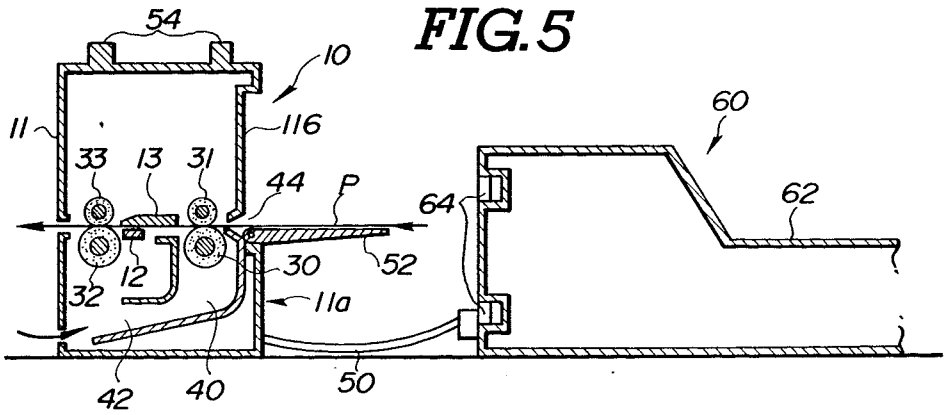
FIG. 5 is a sectional view showing a second embodiment of the printer of the invention.

Referring to FIG. 5, there is illustrated a second embodiment of the invention which is applied to a portable data processor unit including a printer 10 and a data processor 60 connected to the printer 10 through a detachable connection cable 50. The data processor 60 has a keyboard 62 provided on its control panel, a display, an external memory such as using floppy discs, and other components as provided normally in conventional data processor. The operator can input data into the data processor 60 by depressing the appropriate keys of the keyboard 62. The operator can also use the keyboard 62 in providing a command to store the inputted data in the external memory or to transfer the inputted or stored data to the printer 10 for converting the transferred data into printed form on a printing medium such as a printing paper sheet P.

Figure 6:
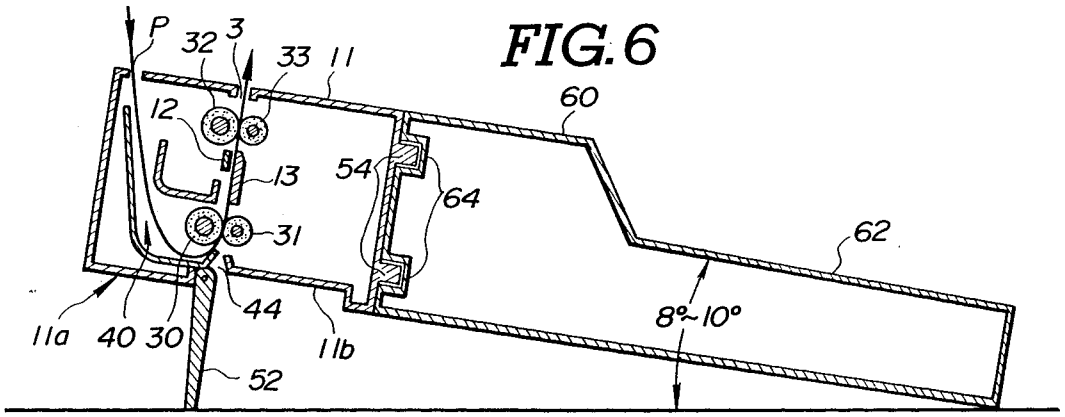
FIG. 6 is a sectional view showing the printer used in another position.

The printer 10 is substantially the same as described in connection with the first embodiment of FIGS. 1 to 4 except for the following respects. First, the printer 10 has a guide plate 52 having a width somewhat wider than the width of the second guide path 44. The guide plate 52 is pivoted on the bottom wall 11*a* of the casing 11 at a position near the entrance of the second guide path 44 so that the guide plate 52 is displaceable between two positions. The first position, illustrated in FIG. 5, results in the guide plate 52 having its upper surface substantially flush with the printing section defined between the platen 12 and the printing head 13 for easy introduction of the printing paper sheet P into the second guide path 44. The second position is encountered when the guide plate 52 is placed in a recess 11*b* (see FIG. 7) formed in the bottom wall 11*a* of the casing 11. Second, the printer 10 has four hooks 54 provided near the corners of one of the side walls of the casing 11. The hooks 54 are received in respective recesses 64 formed in the rear wall of the data processor 60 when the printer 10 is keyed to the data processor 60, as shown in FIG. 6. In the position, illustrated in FIG. 6, the guide plate 52 serves as a leg to incline the control panel surface of the data processor 60 at a desired angle ranging from 8° to 10°.

Figure 7:
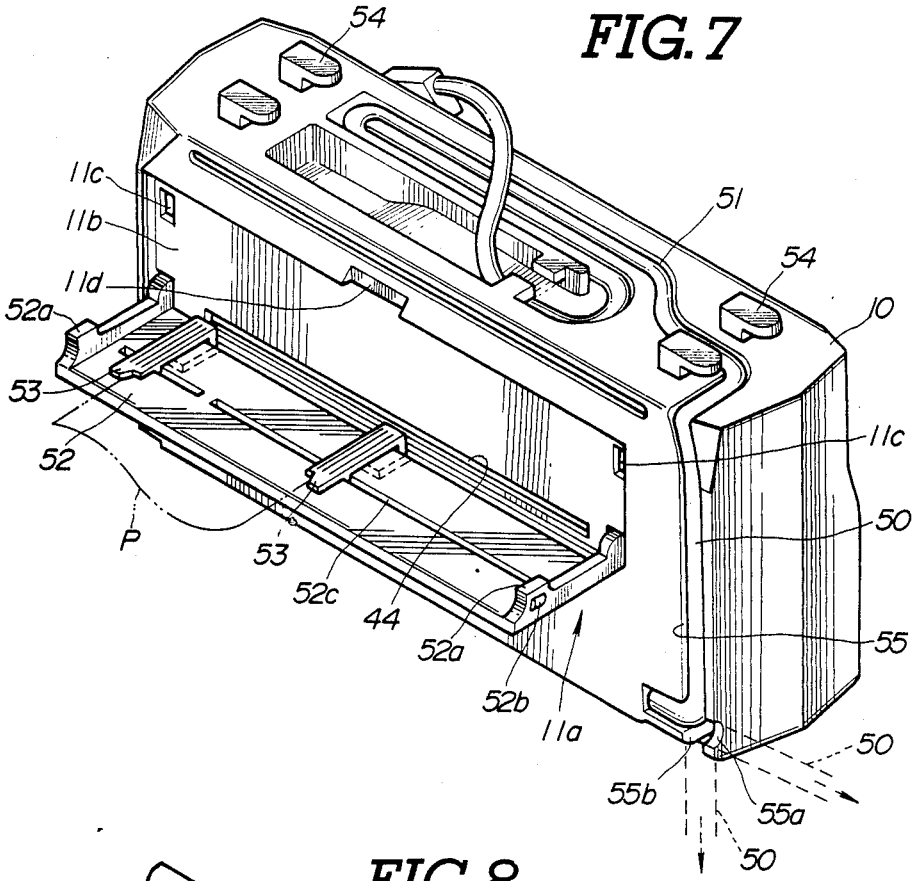
FIG. 7 is a perspective view of the printer of FIG. 5.

Referring to FIG. 7, the guide plate 52 is provided on its opposite sides with side flanges each having a projection 52*a* formed with a boss 52*b* for snap-in engagement of the projection 52*a* with the corresponding recess 11*c* formed in the bottom wall 11*a* of the casing 11 to hold the guide plate 52 in the second position where the guide plate 52 is received in the recess 11*b*. A cutout 11*d* is formed in the bottom wall 11*a* of the casing 11 for insertion of a finger when the guide plate 52 is required to move from the second position to the first position. Preferably, guide members 53 are provided for sliding movement along one or more guide grooves 52*c* formed in the plate 52 so as to vary the distance between the guide members 53 according to the width of the printing paper sheet P used. The numeral 51 is a winding groove formed in the side wall of the casing 11 for receipt the connection cable 50. If the connection cable 50 extends through the bottom wall 11*a* of the casing to its exterior as illustrated, another groove 55 is formed in the bottom wall 11*a* of the casing 11. The groove 55 is connected at its one end to the winding groove 51 and at the other end thereof to cutouts 55*a* and 55*b* as illustrated in FIG. 7.

Figure 8:
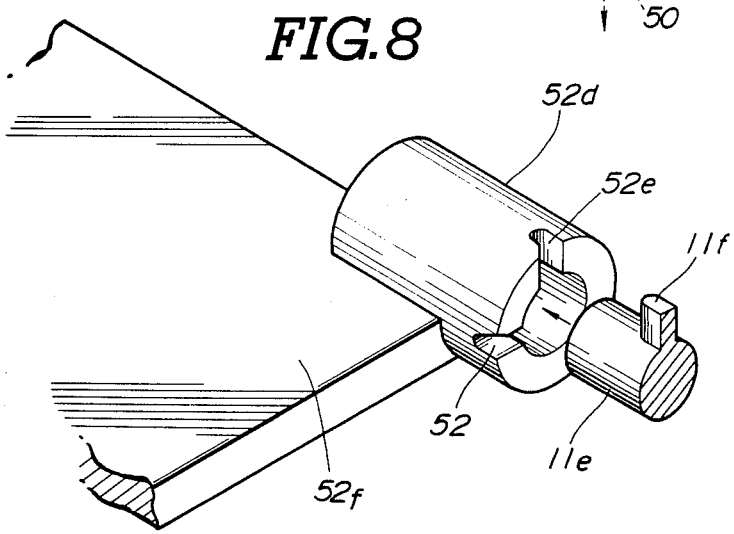
FIG. 8 is a fragmentary perspective view showing one example of manner in which the guide plate is pivoted to the printer casing.

FIG. 8 shows one example of a manner in which the guide plate 52 can be pivoted to the bottom wall 11*a* of the casing 11. The guide plate 52 has a bored cylindrical member 52*d* formed as a unit at each of the two corners thereof near the entrance of the second guide path 44. The cylindrical member 52*d* has first and second cutouts 52*e* and 52*f* formed substantially at 90 degrees apart. The bottom wall 11*a* has a shaft 11*e* having a diameter for free rotation within the center bore of the cylindrical member 52*d*. The shaft 11*e* has an extension 11*f* which engages with the first cutout 52*e* to lock the guide plate 52 in its first position and with the second cutout 52*f* to lock the guide plate 52 in its second position. The extension 11*f* rides over the end surface of the cylindrical member 52*d* into engagement with the first cutout 52*e* when the guide plate 52 moves from the second position to the first position and into engagement with the second cutout 52*f* when the guide plate 52 moves from the first position to the second position.

Figure 9:
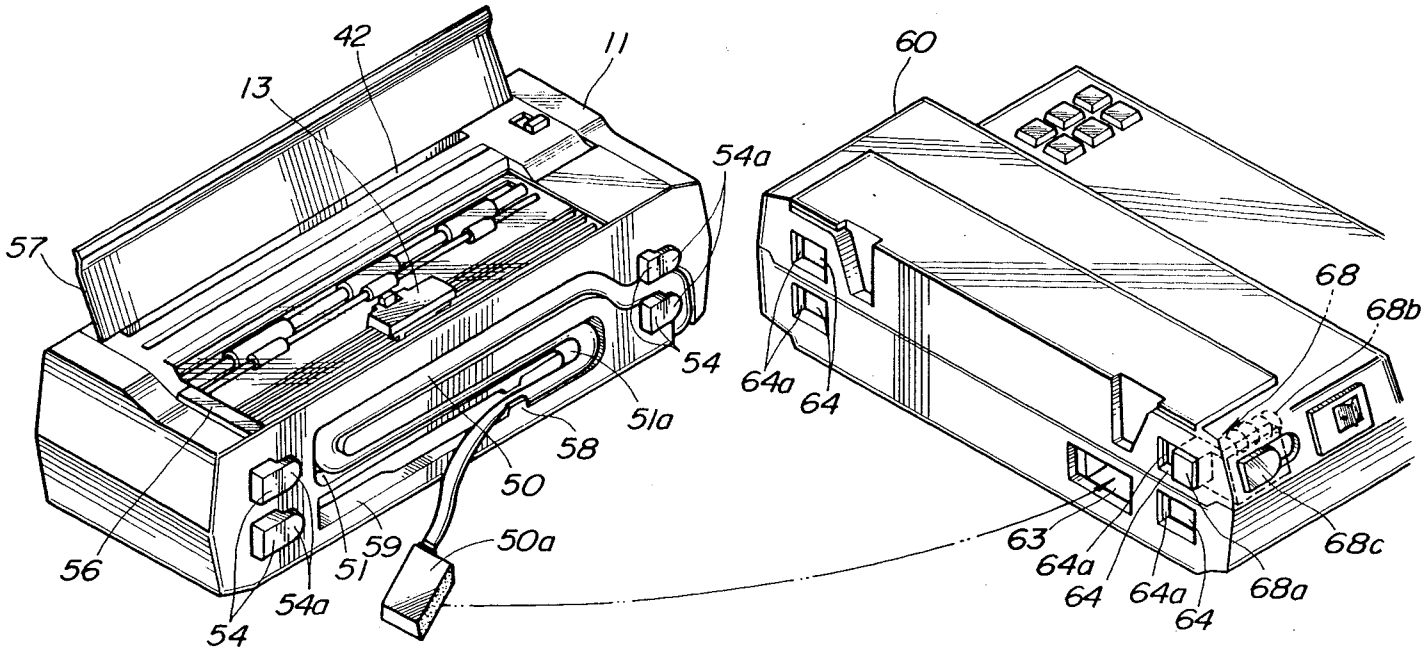
FIG. 9 is a perspective view showing the connectors used in coupling the printer to a data processor.

Referring to FIG. 9, the connection cable 50 terminates at its one end in a cable connector 50*a* which can be received in a recess 59 connected to the winding groove 51. A resilient pawl 58 is formed at an appropriate position to prevent the connection cable 50 from coming out of the winding groove 51. Preferably, the winding groove 51 has an enlarged curved portion for absorbing slack on the connection cable 51. The cable connector 50*a* is received in a recess 63 formed in the data processor 60 when it is used to connect the printer 10 to the data processor 60.

The recesses 64, which are formed in the rear wall of the data processor 60 near the corners thereof, have a size somewhat larger than the size of the respective hooks 54 for receipt of the respective hooks therein. Each of the recesses 64 opens laterally at 64*a* for lateral sliding movement of the corresponding hook 54 within the recess 64 to a lock position where the tip end portion 54*a* of the hook 54 is in engagement with the inner surface of the rear wall of the data processor 60. A locking mechanism 68 includes a locking bar 68*a* provided in cooperation with one of the recesses 64. The locking bar 68*a* is urged under the resilient force of a spring 68*b* to project outward into the corresponding recess 64. The locking bar 68*a* has an operation knob 68*c* extending outward through an opening formed in one side wall of the data processor 60. In order to make a mechanical connection between the printer 10 and the data processor 60, the operator may bring the printer 10 into contact with the data processor 60 with the hooks 54 being in registry with the respective recesses 64. When the hooks 54 are inserted into the respective recesses 64, the locking bar 68*a* is pushed inward against the resilient force of the spring 68*b*. When the operator slides the printer 10 laterally to bring the tip end portions 54*a* of the hooks 54 into engagement with the rear wall of the data processor 60, the locking bar 68*a* projects into the recess 64 under the resilient force of the spring 68*b* to lock the hook 54 in its lock position. The operator can disconnect the printer 10 from the data processor 60 by sliding the operation knob 68*c* inward against the resilient the spring 68*b* and then sliding the printer 10 laterally to a position where the hooks 54 can be released from the respective recesses 64.

It should be understood that the structure for mechanically connecting the printer 10 and the data processor 60 is equally applicable to printers of the type having a single printing medium guide path.

Although the invention has been described in conjunction with specific embodiments thereof, it is evident that many alternatives, modifications and variations will be apparent to those skilled in the art. Accordingly, it is intended to embrace all alternatives, modifications and variations that fall within the scope of the appended claims.

What is claimed is:

1. A printing apparatus comprising:

a printing station including a platen and a printing head, wherein a first or second printing medium guided by said platen is scanned by said printing head for recording information;

first driving means including a first pair of rollers positioned ahead of said printing station for transporting said first or second printing medium toward said printing station, at least one of said rollers of said first pair being resilient and said first or second printing medium being guided by and between said first pair of rollers;

second driving means including a second pair of rollers positioned behind said printing station for drawing said first or second printing medium from said printing station, at least one of said rollers of said second pair being resilient and said first or second printing medium being guided by and between said second pair of rollers;

a casing enclosing said printing station, said first driving means and said second driving means;

first guide means defining a first entrance at an upper surface of said casing for guiding said first printing medium along a curved path to and between said first pair of rollers and having a portion that is spaced apart from one of said pair of rollers by a distance that is somewhat smaller than the thickness of said first printing medium; and second guide means defining a second entrance at a lower surface of said casing for guiding said second printing medium along a straight path to and between said first pair of rollers;

said second driving means defining an exit for said first or second printing medium along a straight path and being positioned with respect to said first guide means so that said first printing medium enters and leaves said printing apparatus on the same side thereof; and said first and second driving means being mounted adjacent to said printing station.

2. A printing apparatus according to claim 1, wherein said first driving means and said second driving means are approximately flush with said first guide means.

3. A printing apparatus according to claim 1, further comprising means for operating said first driving means and said second driving means at an equal operating speed.

4. A printing apparatus comprising:

a printing station including a platen and a printing head, wherein a first or second printing medium guided by said platen is scanned by said printing head for recording information;

first driving means positioned ahead of said printing station for transporting said first or second printing medium toward said printing station;

second driving means positioned behind said printing station for drawing said first or second printing medium from said printing station;

a guide plate defining a first entrance to said first driving means and having a portion that is spaced apart from said first driving means by a distance that is somewhat smaller than the thickness of said first printing medium;

second guide means defining a second entrance to said first driving means;

means defining an exit from said second driving means; and a casing having a lower side and an upper side and covering said printing station, said first and second driving means, and said first and second guide means;

said first driving means and said second driving means being substantially flush with said second guide means, whereby said second printing medium entering said second entrance is guided from said second entrance in a straight path to said second driving means;

said second entrance being on the lower side of said casing, said exit being on the upper side of said casing, and said second entrance being substantially flush with said exit; and said first entrance being on the upper side of said casing and adjacent to said exit.

* * * * *